US011076643B2

(12) United States Patent
Liu

(10) Patent No.: US 11,076,643 B2
(45) Date of Patent: Aug. 3, 2021

(54) ELECTRONIC CIGARETTE HAVING RELIABLY SEALED E-LIQUID INLET

(71) Applicant: Tuanfang Liu, Shenzhen (CN)

(72) Inventor: Tuanfang Liu, Shenzhen (CN)

( * ) Notice: Subject to any disclaimer, the term of this patent is extended or adjusted under 35 U.S.C. 154(b) by 286 days.

(21) Appl. No.: 16/380,996

(22) Filed: Apr. 10, 2019

(65) Prior Publication Data

US 2020/0178615 A1 Jun. 11, 2020

(30) Foreign Application Priority Data

Dec. 10, 2018 (CN) ..... 201811501124.2
Dec. 10, 2018 (CN) ..... 201822059318.3

(51) Int. Cl.
*A24F 13/00* (2006.01)
*A24F 17/00* (2006.01)
*A24F 25/00* (2006.01)
*A24F 40/42* (2020.01)

(52) U.S. Cl.
CPC ..... *A24F 40/42* (2020.01)

(58) Field of Classification Search
CPC ..... A24F 47/002; A24F 47/008; A24F 40/00; A24F 40/40
USPC ..... 131/328, 329
See application file for complete search history.

(56) References Cited

U.S. PATENT DOCUMENTS

2015/0305403 A1* 10/2015 Coelho Belo Fernandes De Carvalho ..... A24F 40/485 131/328
2017/0013881 A1* 1/2017 Liu ..... H05B 3/12

FOREIGN PATENT DOCUMENTS

EP 3574776 A1 * 12/2019 ..... A24F 7/02
GB 2561428 A * 10/2018 ..... A24F 40/42

* cited by examiner

*Primary Examiner* — Hae Moon Hyeon
(74) *Attorney, Agent, or Firm* — Matthias Scholl P.C.; Matthias Scholl

(57) ABSTRACT

An electronic cigarette, including a mouthpiece assembly, an atomizing assembly, and a base assembly. The mouthpiece assembly includes a mouthpiece, a first seal ring adapted to seal the mouthpiece, a decorative ring, a first fixed seat adapted to fix the mouthpiece, a second seal ring adapted to seal the first fixed seat, a decorative cover, a fixed cover, a fixed ring adapted to fix the fixed cover, and a slide block. The atomizing assembly includes a silicone seal, a pin, a spring, a second fixed seat adapted to fix the slide block, a vapor regulating ring, a second seal ring adapted to seal the vapor regulating ring, a glass tube, a third seal ring, a fourth seal ring, and an atomizing unit. The base assembly includes a fifth seal ring, a base, an insulation ring, and a joint.

1 Claim, 6 Drawing Sheets

ELECTRONIC CIGARETTE HAVING RELIABLY SEALED E-LIQUID INLET

CROSS-REFERENCE TO RELAYED APPLICATIONS

Pursuant to 35 U.S.C. § 119 and the Paris Convention Treaty, this application claims foreign priority to Chinese Patent Application No. 201811501124.2 filed Dec. 10, 2018, and to Chinese Patent Application No. 201822059318.3 filed Dec. 10, 2018. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND

This disclosure relates to an electronic cigarette.

Electronic cigarettes atomize nicotine-containing e-liquid. The e-liquid inlet of conventional electronic cigarettes is not sealed tightly enough. In addition, the vapor amount produced is usually either too small or too large, which negatively affects the user experience.

SUMMARY

The disclosure provides an electronic cigarette comprising an e-liquid inlet that is reliably sealed.

Provided is an electronic cigarette, comprising a mouthpiece assembly, an atomizing assembly, and a base assembly. The mouthpiece assembly is disposed on the atomizing assembly. The atomizing assembly is disposed on the base assembly.

The mouthpiece assembly comprises a mouthpiece, a first seal ring adapted to seal the mouthpiece, a decorative ring, a first fixed seat adapted to fix the mouthpiece, a second seal ring adapted to seal the first fixed seat, a decorative cover, a fixed cover, a fixed ring adapted to fix the fixed cover, and a slide block.

The atomizing assembly comprises a silicone seal, a pin, a spring, a second fixed seat adapted to fix the slide block, a vapor regulating ring, a second seal ring adapted to seal the vapor regulating ring, a glass tube, a third seal ring adapted to seal an upper part of the glass tube, a fourth seal ring, and an atomizing unit.

The base assembly comprises a fifth seal ring adapted to seal a lower part of the glass tube, a base, an insulation ring, and a joint.

The first seal ring and the decorative ring are sheathed on the mouthpiece; the mouthpiece is fixed on the first fixed seat; the first fixed seat comprises a side wall comprising an annular groove, and the second seal ring is embedded in the annular groove; the first fixed seat is screwed on the decorative cover; the fixed ring is sheathed on the fixed cover; the decorative cover is disposed on the fixed cover; the slide block is disposed in the fixed cover.

The silicone seal is disposed on the second fixed seat; the second fixed seat comprises an upper annular groove and a lower annular groove, and the second seal ring and the third seal ring are disposed in the upper annular groove and the lower annular groove, respectively; the vapor regulating ring is connected to the second fixed seat; the fourth seal ring is embedded in the second fixed seat; the atomizing unit is inserted in the second fixed seat; the glass tube is in threaded connection to the second fixed seat; the spring is sheathed on the pin; the second fixed seat comprises a location hole, and the pin is inserted in the location hole; the second fixed seat comprises a side wall comprising a plurality of air inlets, and the atomizing unit comprises a side wall comprising a plurality of holes; the plurality of air inlets communicates with the plurality of holes.

The fifth seal ring is sheathed on the base and embedded in the glass tube; the insulation ring is sheathed on the joint; the joint is inserted in a central hole of the base; and the base is in threaded connection to the atomizing unit.

Advantages of the electronic cigarette according to embodiments of the disclosure are summarized as follows. To refill the atomization unit, the fixed cover can be rotated upwards, and the slide block is pushed to one side. The e-liquid inlet of the atomizing assembly is exposed, and the e-liquid can be injected. After refilling, the slide block is pushed back and the fixed cover descends to seal the e-liquid inlet. The second fixed seat comprises a side wall comprising a plurality of air inlets, and the atomizing unit comprises a side wall comprising a plurality of holes. Rotating the vapor regulating ring can expose the air inlets of the second fixed seat. The air inlets communicate with the plurality of holes. The vapor is diffused via the holes on the atomizing unit, producing soft mouthfeel.

DETAILED DESCRIPTION

To further illustrate, embodiments detailing an electronic cigarette are described below. It should be noted that the following embodiments are intended to describe and not to limit the disclosure.

Figure 1:
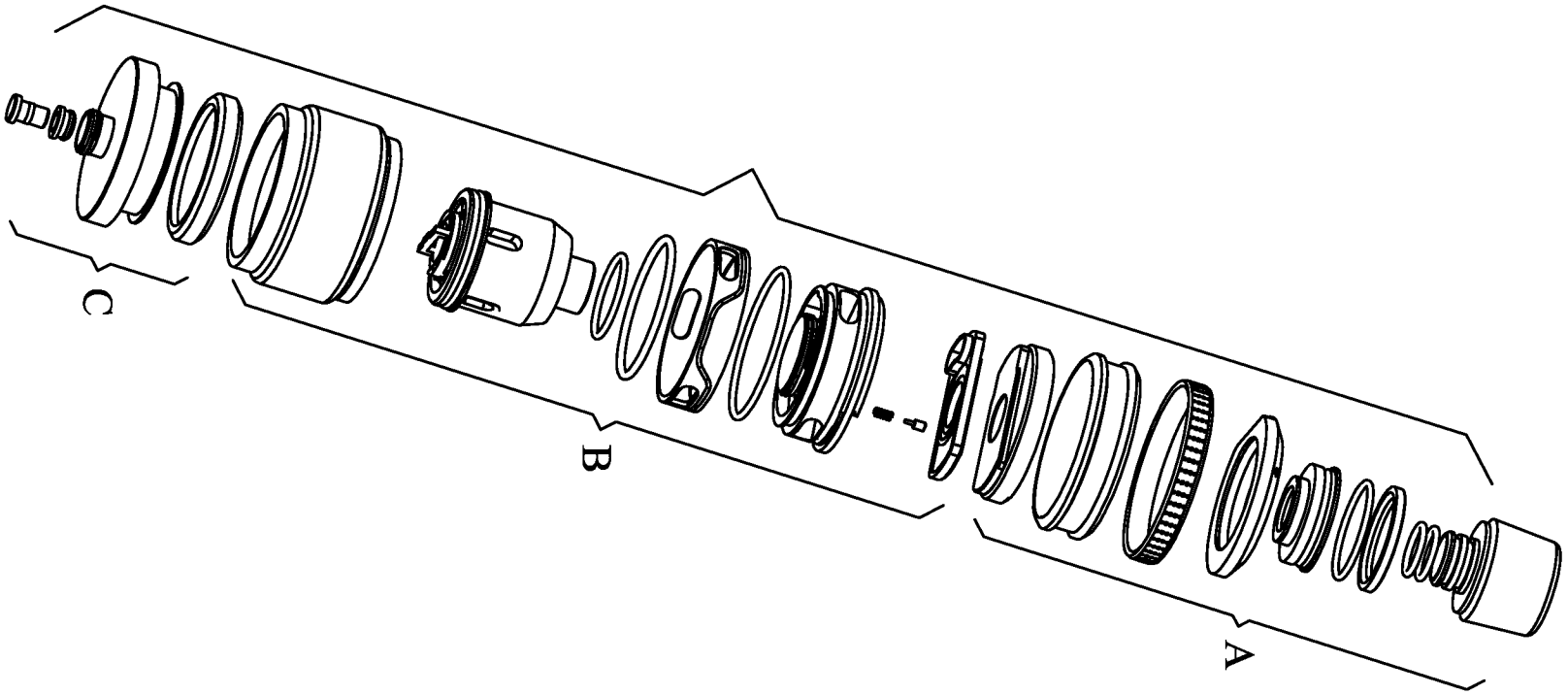
FIG. 1 is an exploded view of an electronic cigarette as described in the disclosure.
Figure 2:
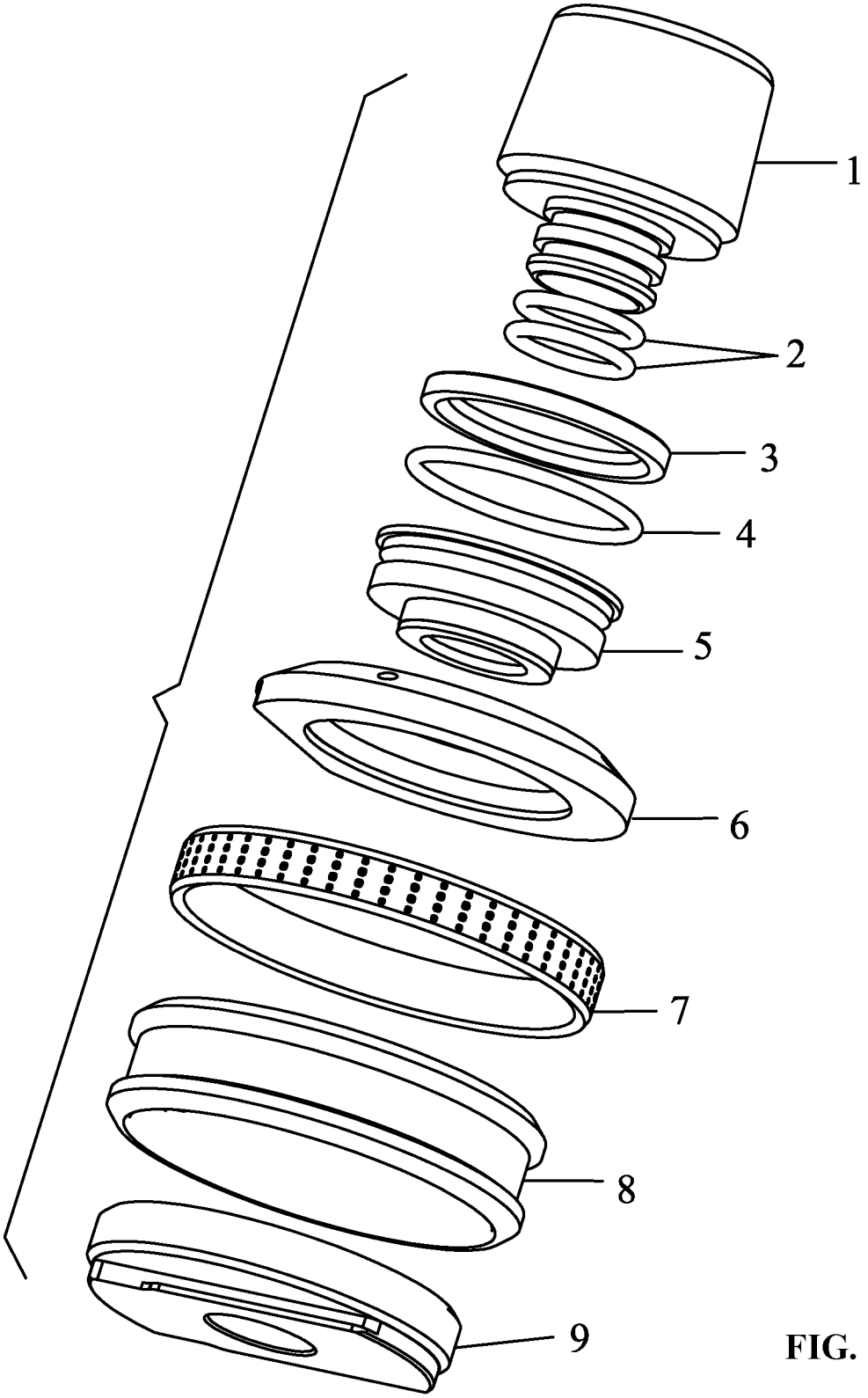
FIG. 2 is an exploded view of a mouthpiece assembly of an electronic cigarette as described in the disclosure
Figure 3:
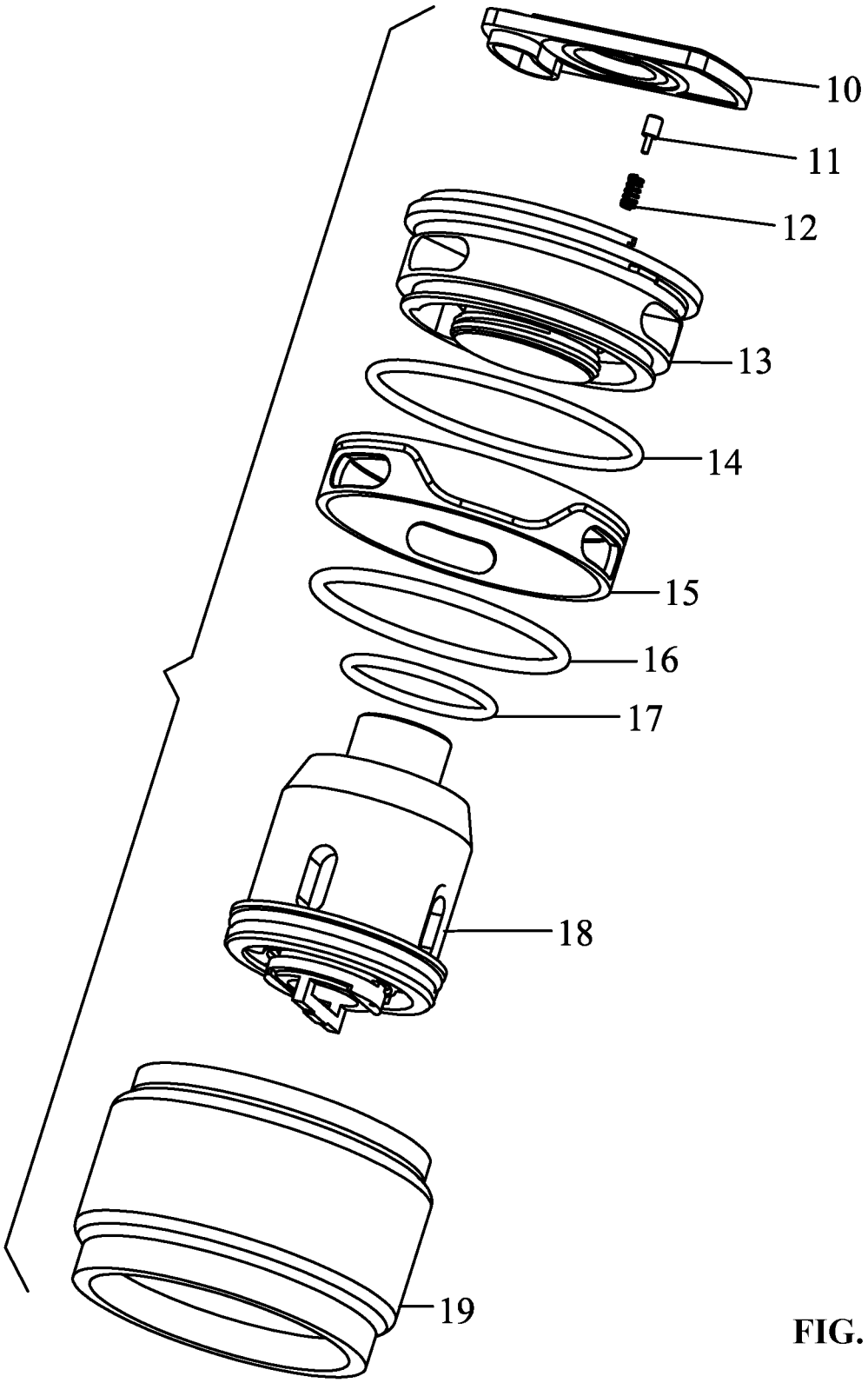
FIG. 3 is an exploded view of an atomizing assembly of an electronic cigarette as described in the disclosure.
Figure 4:
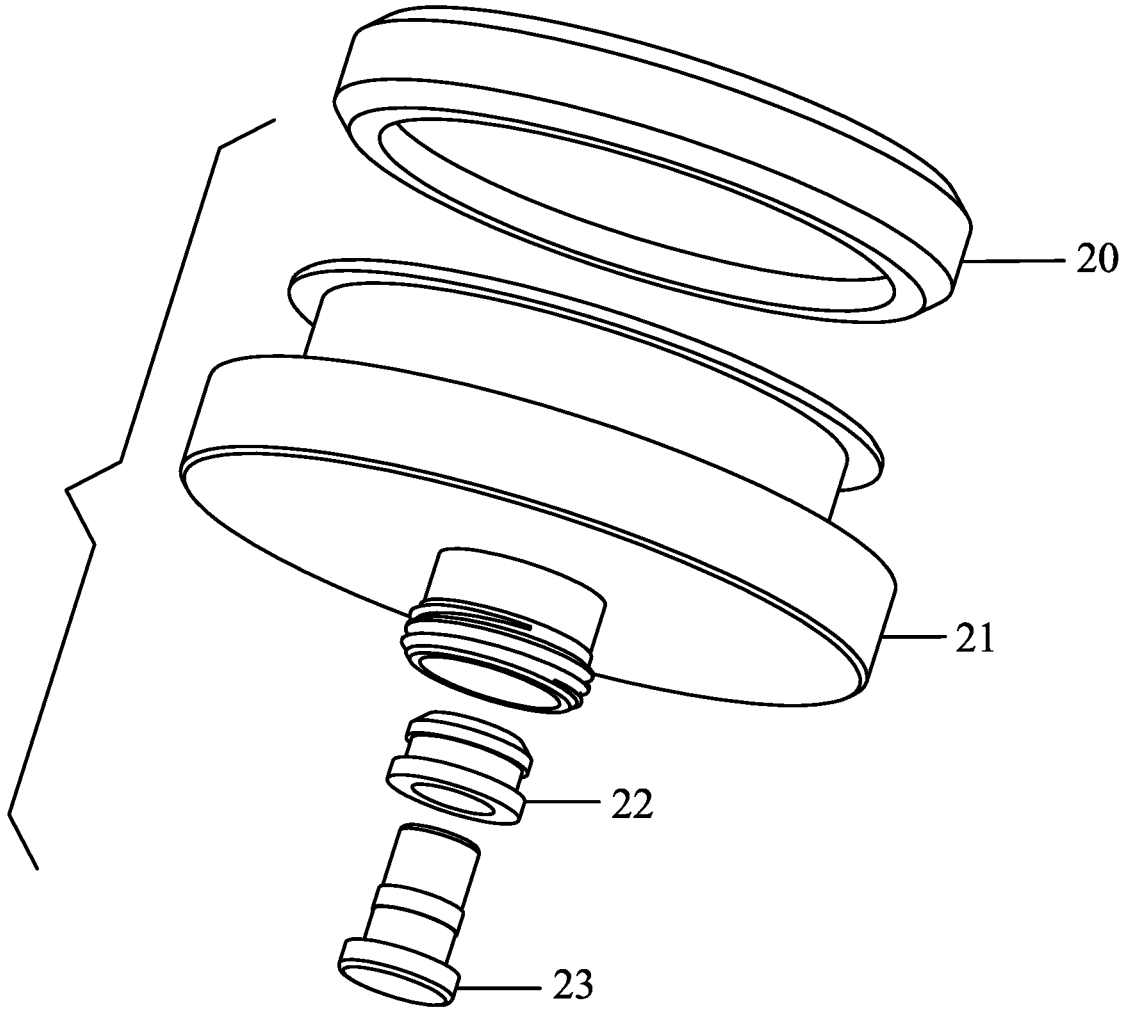
FIG. 4 is an exploded view of a base assembly of an electronic cigarette as described in the disclosure.
Figure 5:
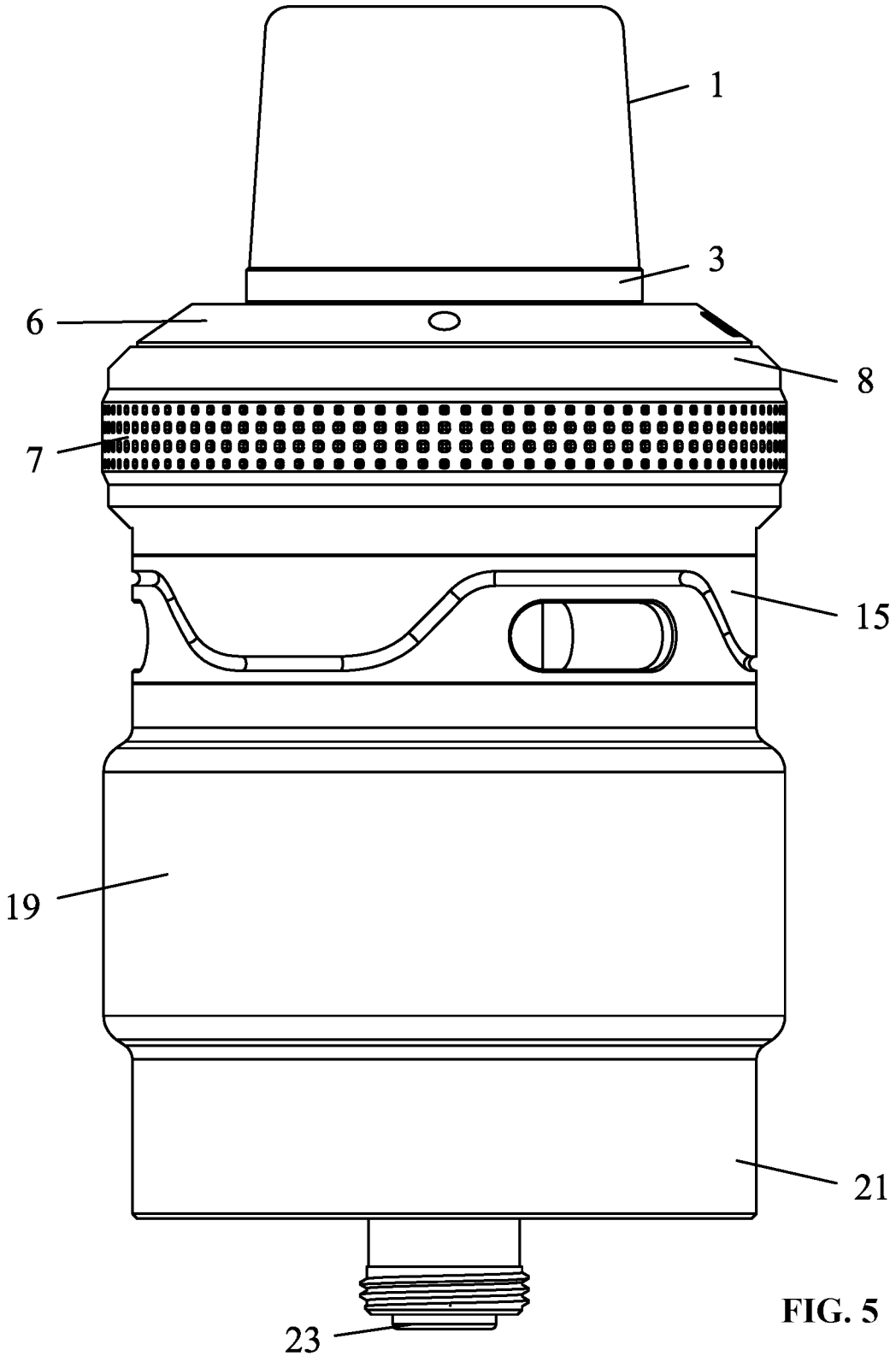
FIG. 5 is a stereogram of an electronic cigarette as described in the disclosure.
Figure 6:
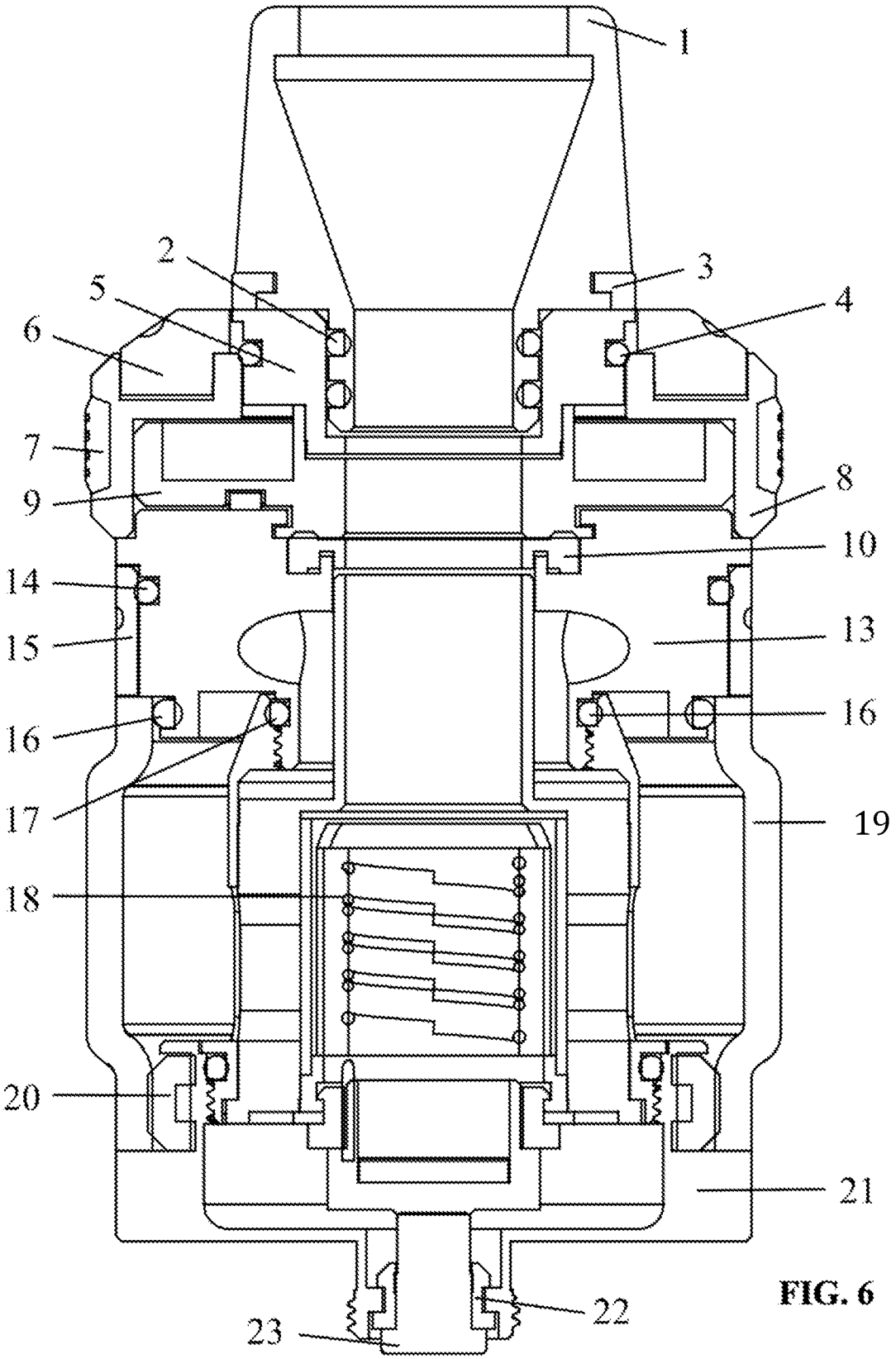
FIG. 6 is a sectional view of an electronic cigarette as described in the disclosure.

As shown in FIGS. 1-6, provided is an electronic cigarette, comprising: a mouthpiece assembly A, an atomizing assembly B, and a base assembly C. The mouthpiece assembly A is disposed on the atomizing assembly B. The atomizing assembly B is disposed on the base assembly C.

The mouthpiece assembly A comprises a mouthpiece 1, a first seal ring 2 adapted to seal the mouthpiece 1, a decorative ring 3, a first fixed seat 5 adapted to fix the mouthpiece 1, a second seal ring 4 adapted to seal the first fixed seat 5, a decorative cover 6, a fixed cover 8, a fixed ring 7 adapted to fix the fixed cover 8, and a slide block 9.

The first seal ring 2 and the decorative ring 3 are sheathed on the mouthpiece 1; the mouthpiece 1 is fixed on the first fixed seat 5; the first fixed seat 5 comprises a side wall comprising an annular groove, and the second seal ring 4 is embedded in the annular groove; the first fixed seat 5 is screwed on the decorative cover 6; the fixed ring 7 is sheathed on the fixed cover 8; the decorative cover 6 is disposed on the fixed cover 8; the slide block 9 is disposed in the fixed cover 8.

The atomizing assembly comprises a silicone seal 10, a pin 11, a spring 12, a second fixed seat 13 adapted to fix the slide block 9, a vapor regulating ring 15, a sixth seal ring 14 adapted to seal the vapor regulating ring 15, a glass tube 19, a third seal ring 16 adapted to seal an upper part of the glass tube 19, a fourth seal ring 17, and an atomizing unit 18.

The silicone seal 10 is disposed on the second fixed seat 13; the second fixed seat 13 comprises an upper annular groove and a lower annular groove, and the sixth seal ring 14 and the third seal ring 16 are disposed in the upper annular groove and the lower annular groove, respectively.

The vapor regulating ring 15 is connected to the second fixed seat 13; the fourth seal ring 17 is embedded in the second fixed seat 13; the atomizing unit 18 is inserted in the second fixed seat 13; the glass tube 19 is in threaded connection to the second fixed seat 13; the spring 12 is sheathed on the pin 11; the second fixed seat 13 comprises a location hole, and the pin 11 is inserted in the location hole; the second fixed seat 13 comprises a side wall comprising a plurality of air inlets, and the atomizing unit 18 comprises a side wall comprising a plurality of holes; the plurality of air inlets communicates with the plurality of holes.

To refill the atomization unit, the fixed cover 8 can be rotated upwards, and the slide block 9 is pushed to one side. The e-liquid inlet of the atomizing assembly is exposed, and the e-liquid can be injected. After refilling, the slide block 9 is pushed back and the fixed cover 8 descends to seal the e-liquid inlet.

The second fixed seat 13 comprises a side wall comprising a plurality of air inlets, and the atomizing unit 18 comprises a side wall comprising a plurality of holes. Rotating the vapor regulating ring 15 can expose the air inlets of the second fixed seat 13. The air inlets communicate with the plurality of holes. The vapor is diffused via the holes on the atomizing unit 18, producing soft mouthfeel.

The base assembly comprises a fifth seal ring 20 adapted to seal a lower part of the glass tube 19, a base 21, an insulation ring 22, and a joint 23. The fifth seal ring 20 is sheathed on the base 21 and embedded in the glass tube 19; the insulation ring 22 is sheathed on the joint 23; the joint 23 is inserted in a central hole of the base 21; and the base 21 is in threaded connection to the atomizing unit 18.

It will be obvious to those skilled in the art that changes and modifications may be made, and therefore, the aim in the appended claims is to cover all such changes and modifications.

What is claimed is:

1. An electronic cigarette, comprising:

a mouthpiece assembly, the mouthpiece assembly comprising a mouthpiece, a first seal ring adapted to seal the mouthpiece, a decorative ring, a first fixed seat adapted to fix the mouthpiece, a second seal ring adapted to seal the first fixed seat, a decorative cover, a fixed cover, a fixed ring adapted to fix the fixed cover, and a slide block;

an atomizing assembly, the atomizing assembly comprising a silicone seal, a pin, a spring, a second fixed seat adapted to fix the slide block, a vapor regulating ring, a sixth seal ring adapted to seal the vapor regulating ring, a glass tube, a third seal ring adapted to seal an upper part of the glass tube, a fourth seal ring, and an atomizing unit; and a base assembly, the base assembly comprising a fifth seal ring adapted to seal a lower part of the glass tube, a base, an insulation ring, and a joint;

wherein:

the first seal ring and the decorative ring are sheathed on the mouthpiece; the mouthpiece is fixed on the first fixed seat; the first fixed seat comprises a side wall comprising an annular groove, and the second seal ring is embedded in the annular groove;

the first fixed seat is screwed on the decorative cover; the fixed ring is sheathed on the fixed cover; the decorative cover is disposed on the fixed cover; the slide block is disposed in the fixed cover;

the silicone seal is disposed on the second fixed seat; the second fixed seat comprises an upper annular groove and a lower annular groove, and the sixth seal ring and the third seal ring are disposed in the upper annular groove and the lower annular groove, respectively;

the vapor regulating ring is connected to the second fixed seat; the fourth seal ring is embedded in the second fixed seat; the atomizing unit is inserted in the second fixed seat; the glass tube is in threaded connection to the second fixed seat;

the spring is sheathed on the pin; the second fixed seat comprises a location hole, and the pin is inserted in the location hole;

the second fixed seat comprises a side wall comprising a plurality of air inlets, and the atomizing unit comprises a side wall comprising a plurality of holes; the plurality of air inlets communicates with the plurality of holes; and the fifth seal ring is sheathed on the base and embedded in the glass tube; the insulation ring is sheathed on the joint; the joint is inserted in a central hole of the base; and the base is in threaded connection to the atomizing unit.

* * * * *